United States Patent [19]

Fowler, Jr.

[11] Patent Number: 4,549,759

[45] Date of Patent: Oct. 29, 1985

[54] FORKLIFT-TYPE LIFTING APPARATUS

[75] Inventor: Aubrey A. Fowler, Jr., Fairmont, N.C.

[73] Assignees: Joseph W. Walker, Fayetteville; Southeastern Crane Fork, Richmond County, both of N.C.

[21] Appl. No.: 487,319

[22] Filed: Apr. 21, 1983

[51] Int. Cl.[4] ..... B66C 1/22

[52] U.S. Cl. ..... 294/67.2; 294/81.1; 294/67.21

[58] Field of Search ..... 294/81 R, 67 A, 67 AA, 294/67 AB, 63 R, 82 R, 103 R, 88; 414/715, 719, 722, 723, 785, 608, 640, 641, 642, 673

[56] References Cited

U.S. PATENT DOCUMENTS 3,661,415 5/1972 Piasecki ..... 294/81 R 3,897,097 7/1975 Davis, Jr. ..... 294/67 A

*Primary Examiner*—James B. Marbert

*Attorney, Agent, or Firm*—B. B. Olive

[57] ABSTRACT

A forklift-type lifting apparatus comprises a pair of C-shaped claws or forks and integral frame structure and is adapted to be initially supported from a center spring-loaded cable. The center or point of balance cable assumes a taut position as a load is lifted and four outer corner cables take up the load. Alternatively, after the load is being supported by the outer four cables, the center spring-loaded cable may be detached.

2 Claims, 3 Drawing Figures

FORKLIFT-TYPE LIFTING APPARATUS

DESCRIPTION

1. Technical Field

The invention relates to crane, hoist, or the like, load-lifting devices and more specifically to a forklift-type apparatus that can be employed for use with such lifting devices.

2. Background Art

Forklift trucks have proven to be extremely useful in moving loads by means of inserting forks under the loads and raising the loads with the forks. Variations of the forklift-type structure for crane lifting are to be found in U.S. Pat. Nos. 3,897,097 and 3,971,478. However, so far as applicant is aware, forklift-type lifting devices have not been widely applied in crane lifting and it is believed that one of the reasons for this is the fact that the prior art crane forklift devices have not adapted to lifting loads placed on nonlevel surfaces. Thus, the object of the invention becomes that of providing an improved forklift-type lifting apparatus for use with cranes, hoists, or the like.

3. Disclosure of Invention

A crane, hoist, or the like, forklift-type lifting apparatus according to the invention provides a pair of laterally spaced, C-shaped claws or forks with a four point cable support at the four corners of the frame to which the claws are attached. Additionally, there is provided a spring-loaded, releasable, central cable at the point of balance of the forklift-type lifting apparatus. In operation, the invention apparatus, for purposes of loading, can be tilted or maneuvered in essentially any direction so as to place the C-shaped claws or fork tongues under the load even if on a nonlevel surface and then gradually apply the lifting force first to the spring-loaded center cable and then gradually to the other cables at the outer four corner points of support.

BEST MODE FOR CARRYING OUT THE INVENTION

Figure 1:
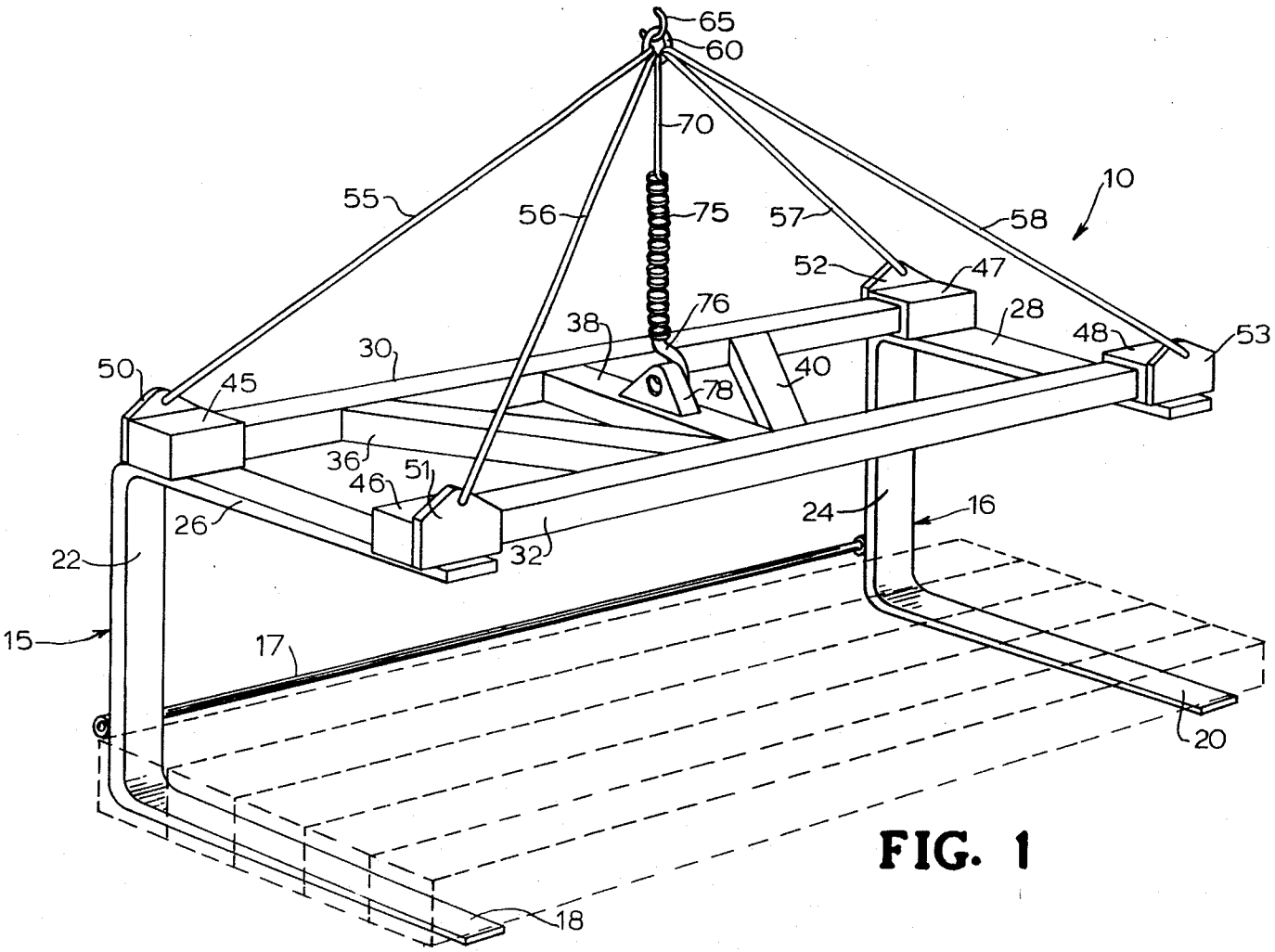
FIG. 1 is a perspective view of the forklift-type lifting apparatus of the invention with the outer cables shown taut and the center spring-loaded cable without slack and the spring stretched as the apparatus would be at the point of beginning to lift a simulated load as illustrated in dashed lines.

The forklift-type lifting apparatus 10 of the invention comprises a pair of laterally-spaced, C-shaped claws or forks 15, 16 formed by tongues 18, 20, backrests 22, 24, bar 17 extending and frame bars 26, 28.

A structurally rigid frame is established by welding C-claw frame bars 26, 28, crossbars 30, 32, brace bars 36, 38, 40, and terminal blocks 45, 46, 47, 48 together. Cable support brackets 50, 51, 52 and 53 at the outer four corners of the frame receive and are secured to the lower ends of the main support cables 55, 56, 57, 58, all of which are of fixed length and are secured at the upper ends to a lift ring 60 which in turn is received by hook 65 which is attached to the main crane or hoist cable 66.

A principal feature of the invention is provided by the center lift cable 70 attached to the lift bracket 78 through a spring 75 and detachable hook 76.

From the foregoing description, it can be seen that if hook 76 is detached, a load can be lifted through the four points of support by taut cables 55, 56, 57, 58 at cable brackets 50, 51, 52, 53 and thus all of the advantages of a forklift can be achieved in a crane, hoist, or the like, lifting operation.

Figure 2:
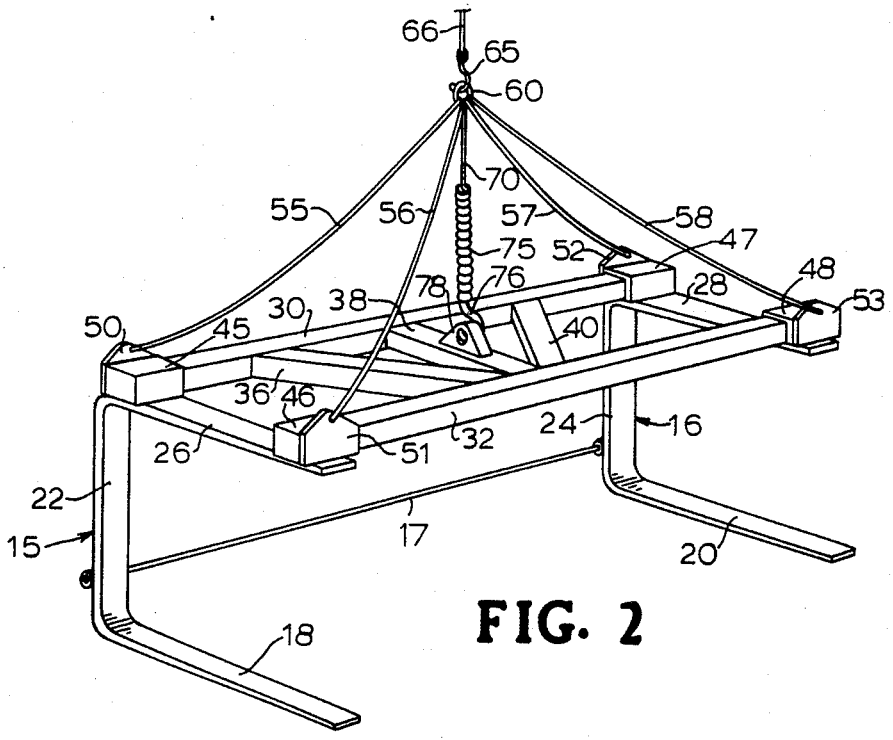
FIG. 2 is a reduced scale perspective view of the invention apparatus resting on what is assumed to be an uneven surface and with the outer cables slack and the center spring-supported cable being taut and used as a point of balance for maneuvering the forklift-type lifting apparatus fore and aft and up and down into proper position prior to lifting a load.

Alternatively, preparatory to loading as in FIG. 2, the central cable 70 can be left in position with hook 76 installed in bracket 78 and the entire forklift-type lifting apparatus 10 with cable 70 taut and supporting the forklift apparatus 10 can then be tilted or maneuvered around the point of balance which is purposely located at the location of bracket 78 so as to accommodate the positioning of forklift-type lifting apparatus 10 to uneven conditions on which the load is resting prior to being lifted.

Figure 3:
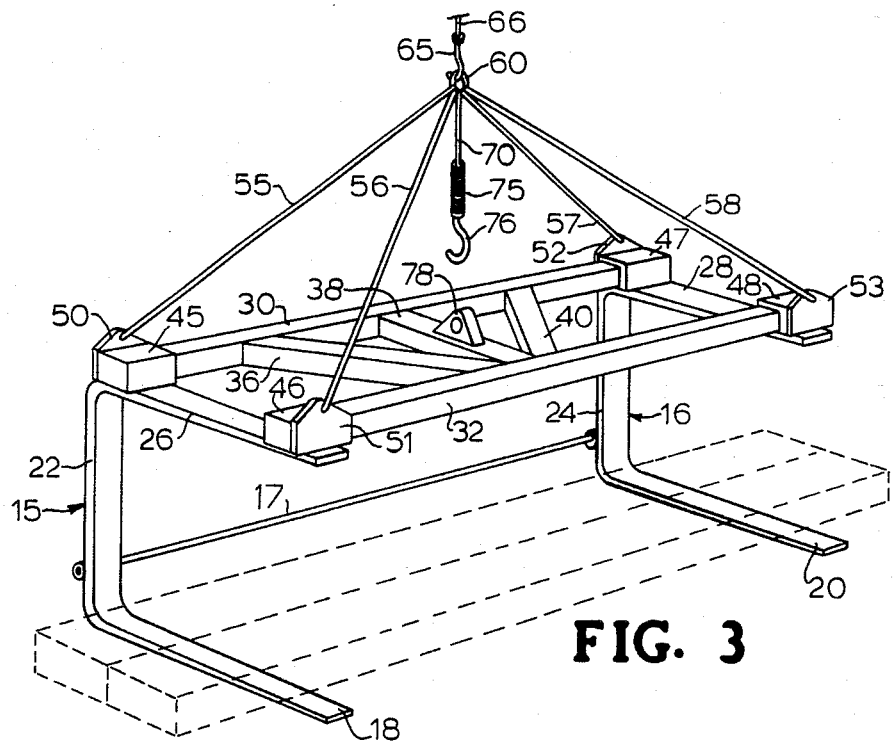
FIG. 3 is a reduced scale perspective view which illustrates an alternative arrangement in which the outer cables are taut, the forklift-type lifting apparatus is shown in dashed lines as being loaded and the center spring-loaded cable is shown detached so that all of the load is being applied to the four outer cables.

Particularly, when lifting loads from uneven surfaces, it will also be seen that the load applied by crane or hoist lift cable 66 can be gradually applied to the forklift-type lifting apparatus 10 by first stretching spring 75 with force applied to central lift cable 70, see FIG. 2, and then as in FIG. 1 apply the load to the outer main cables 55, 56, 57 and 58. If so desired, spring 75 can be further stretched and hook 76 removed from bracket 78, see FIG. 3, so that only a four point lift is in use.

Thus, in summary, the forklift-type lifting apparatus of the invention provides a point of balance which allows tilting or maneuvering of apparatus 10 in any direction, i.e., fore, aft, or up and down, during loading and particularly when the load is on an uneven surface. Further, when the four main cables tighten, this allows the four outer corners of forklift-type lifting apparatus 10 to assume the load and, if desired, the disconnection of center spring-loaded cable 70.

What is claimed is:

1. A forklift-type lifting apparatus for use with overhead cranes, hoists, or the like, comprising:

(a) a pair of C-shaped claws, each said C-shaped claw having a normally-horizontally positioned tongue member for load support, a vertical backrest member and overlying and parallel to said tongue member a frame bar member;

(b) a frame structure mounted on and secured to the frame bar members of said claws and serving to laterally space said claws such that said claws assume essentially parallel positions and are held in a rigid secured position on said frame structure;

(c) four cable attachments provided at the four outer corners of said frame structure above said claws;

(d) a set of four main lift cables of fixed length, each said main lift cable being attached at one end to one of said cable attachments and at the opposite end to a lift connector providing means for interconnecting said opposite end of said four main lift cables to a single lifting cable;

(e) a central cable structure comprising an interconnected hook, spring member and capable of fixed length, said cable structure having one end attached to said connector and the opposite end terminating in said hook; and (f) a bracket member located on said frame substantially at the point of balance and having an opening for releasably receiving said hook, the length of said main cables, the length of said central cable structure cable and the force of said spring member being selected such that said forklift-type lifting apparatus when unloaded with said hook installed in said bracket can be supported solely by said central cable structure and maneuvered around said point of balance preparatory to loading on uneven surfaces and when said hook is removed from said bracket or left in said bracket said forklift-type lifting apparatus when loaded is adapted to lift the load through the lift support provided by said four main cables.

2. A forklift-type lifting apparatus as claimed in claim 1 wherein said point of balance and said bracket member are located substantially centrally of the length and width of said frame structure and said frame bar members of said C-shaped claws are secured to and form end members of said frame structure.

* * * * *

UNITED STATES PATENT AND TRADEMARK OFFICE

CERTIFICATE OF CORRECTION

PATENT NO. : 4,549,759

DATED : October 29, 1985

INVENTOR(S) : Aubrey A. Fowler, Jr.

It is certified that error appears in the above-identified patent and that said Letters Patent is hereby corrected as shown below:

Column 2, line 68, "capable" should read -- cable --..

Signed and Sealed this

*Twenty-first* Day of *January 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,549,759

DATED : October 29, 1985

INVENTOR(S) : Aubrey A. Fowler, Jr.

It is certified that error appears in the above-identified patent and that said Letters Patent is hereby corrected as shown below:

Column 1, line 66, insert -- between backrests 22, 24 -- after "extending".

Column 2, line 68, "capable" should read -- cable --.

This certificate supersedes Certificate of Correction issued January 21, 1986.

Signed and Sealed this

*Fourth* Day of *March 1986*

[SEAL]

*Attest:*

DONALD J. QUIGG

*Attesting Officer*

*Commissioner of Patents and Trademarks*